US011283153B2

(12) United States Patent
Bonnet

(10) Patent No.: US 11,283,153 B2
(45) Date of Patent: Mar. 22, 2022

(54) ANTENNA FOR MOBILE COMMUNICATION DEVICE

(71) Applicant: STMICROELECTRONICS (TOURS) SAS, Tours (FR)

(72) Inventor: Benoit Bonnet, Tours (FR)

(73) Assignee: STMICROELECTRONICS (TOURS) SAS, Tours (FR)

( * ) Notice: Subject to any disclaimer, the term of this patent is extended or adjusted under 35 U.S.C. 154(b) by 0 days.

(21) Appl. No.: 16/530,493

(22) Filed: Aug. 2, 2019

(65) Prior Publication Data

US 2019/0356039 A1 Nov. 21, 2019

Related U.S. Application Data

(63) Continuation of application No. 15/691,285, filed on Aug. 30, 2017, now Pat. No. 10,403,963.

(30) Foreign Application Priority Data

Jan. 19, 2017 (FR) ..... 1750418
Jan. 19, 2017 (FR) ..... 1750419

(51) Int. Cl.

| | |
|---|---|
| ***H01Q 9/00*** | (2006.01) |
| ***H01Q 1/24*** | (2006.01) |
| ***H01Q 9/04*** | (2006.01) |
| ***H01Q 5/30*** | (2015.01) |
| ***H01Q 5/328*** | (2015.01) |
| ***H01Q 9/42*** | (2006.01) |
| *H01Q 1/48* | (2006.01) |

(52) U.S. Cl.
CPC ..... *H01Q 1/242* (2013.01); *H01Q 1/243* (2013.01); *H01Q 5/30* (2015.01); *H01Q 5/328* (2015.01); *H01Q 9/0421* (2013.01); *H01Q 9/42* (2013.01); *H01Q 1/48* (2013.01)

(58) Field of Classification Search
CPC ..... H01Q 1/242; H01Q 5/328; H01Q 1/243; H01Q 9/42; H01Q 9/0421; H01Q 5/30; H01Q 1/48; H01Q 1/36; H01Q 1/50
See application file for complete search history.

(56) References Cited

U.S. PATENT DOCUMENTS

| | | | | |
|---|---|---|---|---|
| 2004/0041734 | A1 | 3/2004 | Shiotsu et al. | |
| 2009/0128428 | A1 | 5/2009 | Ishizuka et al. | |
| 2010/0022197 | A1* | 1/2010 | Kato | H04B 1/005 455/75 |
| 2011/0250928 | A1 | 10/2011 | Schlub et al. | |
| 2013/0154897 | A1 | 6/2013 | Sorensen et al. | |
| 2014/0266922 | A1 | 9/2014 | Jin et al. | |
| 2015/0118984 | A1 | 4/2015 | Nagumo et al. | |
| 2015/0249916 | A1 | 9/2015 | Schlub et al. | |

(Continued)

FOREIGN PATENT DOCUMENTS

| | | | |
|---|---|---|---|
| CN | 103339796 | A | 10/2013 |
| CN | 105449364 | A | 3/2016 |

(Continued)

*Primary Examiner* — Dieu Hien T Duong
(74) *Attorney, Agent, or Firm* — Slater Matsil, LLP

(57) ABSTRACT

The invention relates to an antenna comprising: an elongate conducting band; an antenna socket; a connection to earth; at least one first capacitive element of adjustable capacitance; and at least one first inductive element in series with the first capacitive element.

20 Claims, 2 Drawing Sheets

(56) References Cited

U.S. PATENT DOCUMENTS

| | | | | |
|---|---|---|---|---|
| 2016/0365623 | A1 | 12/2016 | Kim et al. | |
| 2017/0310012 | A1* | 10/2017 | Wong | H01Q 5/328 |
| 2018/0090816 | A1* | 3/2018 | Mow | H01Q 1/22 |
| 2019/0131716 | A1* | 5/2019 | Xue | H01Q 1/44 |

FOREIGN PATENT DOCUMENTS

| | | | |
|---|---|---|---|
| EP | 2528165 | A1 | 11/2012 |
| GB | 2463536 | A | 3/2010 |

* cited by examiner

ANTENNA FOR MOBILE COMMUNICATION DEVICE

CROSS-REFERENCE TO RELATED APPLICATIONS

This application is a continuation application of U.S. application Ser. No. 15/691,285, filed Aug. 30, 2017, which claims priority to French Patent Application No. 1750418, filed on Jan. 19, 2017, and French Patent Application No. 1750419 filed on Jan. 19, 2017, which all applications are hereby incorporated herein by reference.

TECHNICAL FIELD

The present description relates generally to electronic devices and, more particularly, to antennas used by transmission circuits with which mobile communication devices are equipped. The present description envisages more particularly an antenna of short-circuited quarter-wave type (PIFA antenna—Planar Inverted-F Antenna) for handheld telecommunication equipment of mobile telephony type.

BACKGROUND

A mobile telephone antenna is generally disposed at the level of the casing or shell of the telephone so as not to be screened by metallic elements. The antenna is then linked to the telephone's internal electronic transmission circuits.

The proliferation in the frequency bands usable in mobile telephones and in tablets is driving provision for wideband and/or frequency-tunable antennas.

SUMMARY would be desirable to have a radiofrequency antenna architecture that can operate effectively in various frequency bands.

It would be desirable to have a solution that is particularly suited to the frequency bands used in mobile telecommunication devices.

It would be desirable to have a solution that is suited to existing transmission circuits.

Thus, an embodiment provides for an antenna includes an elongate conducting band, an antenna socket, a connection to earth, at least one first capacitive element of adjustable capacitance, and at least one first inductive element in series with the first capacitive element.

According to one embodiment, the inductance value of the first inductive element is at least five times greater than the inductance value of the connection to earth.

According to one embodiment, the antenna furthermore comprises a second capacitive element of adjustable capacitance linking the conducting band to earth.

According to one embodiment, the distance between the respective points of attachment of the second capacitive element and of the series association of the first capacitive element and of the first inductive element, to the band, is less than the distance between the point of attachment of the second capacitive element and the connection to earth.

According to one embodiment, the second capacitive element is in parallel with the series association of the first capacitive element and of the first inductive element.

According to one embodiment, the antenna furthermore comprises a second inductive element linking the conducting band to earth.

According to one embodiment, the distance between the respective points of attachment of the second inductive element and of the series association of the first capacitive element and of the first inductive element, to the band, is less than the distance between the point of attachment of the second inductive element and the connection to earth.

According to one embodiment, the second inductive element is in parallel with the series association of the first capacitive element and of the first inductive element.

According to one embodiment, the inductance value of the second inductive element is at least five times greater than the inductance value of the connection to earth.

According to one embodiment, the antenna constitutes a short-circuited quarter-wave antenna.

According to one embodiment, the antenna is dimensioned for passbands in the range lying between about 700 MHz and 2.7 GHz.

According to one embodiment, the antenna is dimensioned for passbands in the range lying between about 470 MHz and 3 GHz.

An embodiment also provides for a portable telecommunication device comprising at least one antenna.

BRIEF DESCRIPTION OF THE DRAWINGS

These characteristics and advantages, as well as others, will be set forth in detail in the following nonlimiting description of particular embodiments, given in conjunction with the appended figures among which.

DETAILED DESCRIPTION OF ILLUSTRATIVE EMBODIMENTS

Like elements have been designated by like references to the various figures.

For the sake of clarity, only the elements useful to the understanding of the embodiments which will be described have been represented and will be detailed. In particular, the manner of operation and the structure of a whole radiofrequency transmission chain have not been detailed, the embodiments described being compatible with the usual transmission chains. In the description which follows, when reference is made to the terms "approximately", "about" and "of the order of", this signifies to within 10%, preferably to within 5%.

Figure 1:
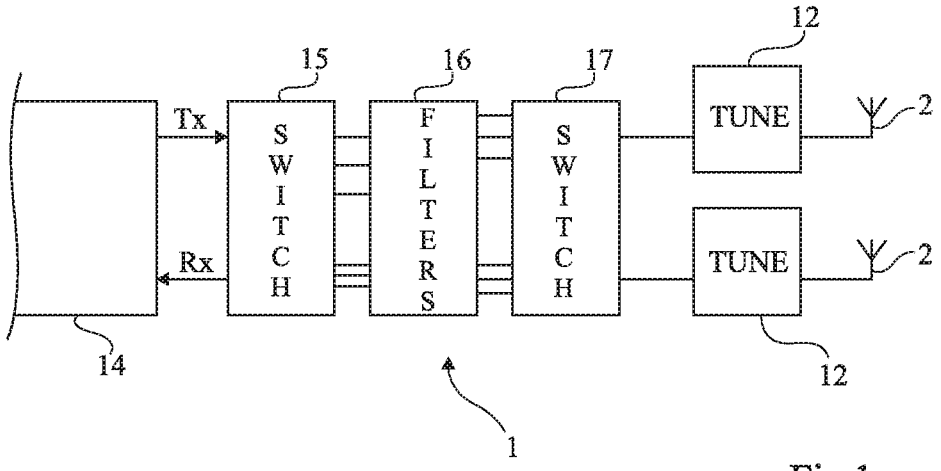
FIG. 1 is a block diagram of an exemplary radiofrequency transmission chain 1 of the type to which the embodiments which will be described apply.

FIG. 1 is a block diagram of an exemplary radiofrequency transmission chain 1 of the type to which the embodiments which will be described apply.

Such a chain is, in the applications envisaged by the present description, multifrequency in transmission and in reception. One or (usually) several antennas 2 are connected individually to a frequency-adjustment circuit 12 (TUNE).

In transmission, signals Tx to be transmitted are generated by electronic circuits 14 and are provided by one or more power amplifiers (PA) to an array of switches 15 (SWITCH), whose role is to steer the signals towards a filter of an array of filters 16 (FILTERS) as a function of the frequency band considered. The outputs (in transmission) of the filters are linked to another array of antenna switches 17 (SWITCH) responsible for selecting the output of the filter used and for linking it to the adjustment circuit 12 of an antenna 2.

In reception, the received signals Rx perform a similar but reverse journey, from the circuit 12 of the antenna 2 picking up the signals in the appropriate frequency band, through the array of switches 17 so as to be filtered by one of the filters of the array 16, and then steered by the array of switches 15 to a reception amplifier (generally a low noise amplifier—LNA) of the circuit 14.

Figure 2A:
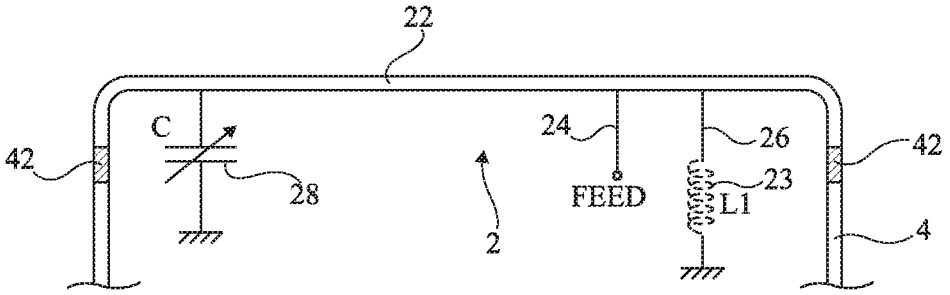
FIGS. 2A and 2B are schematic representations of short-circuited quarter-wave antennas.
Figure 2B:
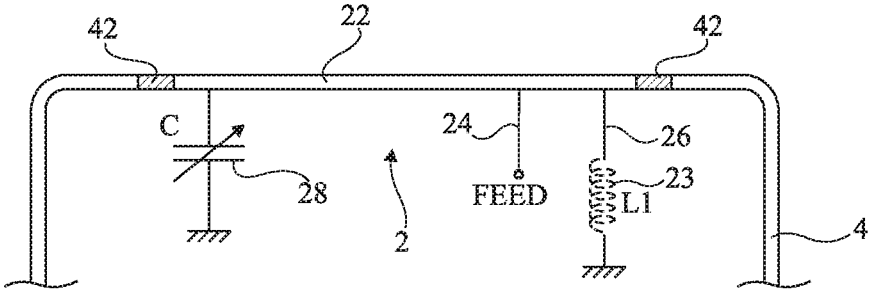

FIGS. 2A and 2B are schematic representations of short-circuited quarter-wave antennas, also called inverted-F antennas, which are more particularly envisaged by the embodiments described. Indeed, antennas of this type are generally used in mobile telephones and in tablets. More precisely, the antennas preferentially envisaged are PIFA antennas (Planar Inverted-F Antennas) which are formed on the basis of a conducting plane, often in the form of a conducting plane band 22, overlaid as internal face or constituting a portion of a peripheral region of a shell 4 of the telephone. In the latter case, the conducting plane band 22 is then insulated from the remainder of the shell 4 by electrically insulating portions 42 of the latter.

FIGS. 2A and 2B illustrate an exemplary antenna 2 formed on a small side of the periphery of the shell 4 of a telephone. The case of a telephone of rectangular general form is assumed. However, everything that will be described applies more generally to any PIFA antenna whether or not it is carried by the periphery of the shell of the telephone. These figures diagrammatically show sectional views of a telephone shell 4 part.

FIG. 2A illustrates the case of an antenna 2 whose length requires that it overhangs the small side. The antenna 2 therefore extends partially over the lateral edges of the shell 4.

FIG. 2B illustrates the case of an antenna 2 whose length is such that it is wholly contained in the small side of the periphery of the shell 4.

A PIFA antenna comprises at least an elongate conducting band 22; an antenna socket 24 (FEED) intended to be connected to the circuits of the telephone (in reception or in transmission), for example, to a circuit 12 or directly to the array 17 of FIG. 1; and a connection 26 to earth.

The socket 24 and the connection 26 are disposed in one and the same side of the band 22, typically in an end quarter of the band 22. The connection 26 is equivalent to an inductive element 23 (represented dashed) of inductance L1 linking the band 22 to earth. According to the embodiments, this inductance L1 originates from the intrinsic inductance of the connection 26 or is that of a discrete inductive component.

In the PIFA antennas envisaged by the present description, which are multiband antennas, the antenna 2 furthermore comprises a capacitive element 28 of adjustable capacitance C linking the band 22 to earth. The connection from the capacitive element 28 to the band 22 is situated in the other half of the length of the band 22 with respect to that receiving the socket 24 and the connection 26. The socket 24 may be on either side of the connection 26 with respect to the element 28. The capacitive element 28 is controlled by the circuits 14 (FIG. 1) as a function of the desired operating frequency band or bands.

For an antenna, the passband is defined for a standing wave ratio (Voltage Standing Wave Ratio—VSWR) of 3, this being equivalent to reflection losses (Return Loss—RL) of −6 dB. Stated otherwise, this corresponds to the frequency band in which at least 75% of the power is transmitted to the antenna.

The respective positions of the connection 26 and the capacitive element 28 as well as the respective values of the inductance L1 and of the capacitance C determine the resonant frequency of the antenna 2, otherwise fixed by the size of the band 22. In a simplified manner, without the capacitive element 28 and with the connection 26 at the end of the band 22, the sum of the length and of the width of a rectangular band 22 corresponds to a quarter ($\lambda/4$) of the wavelength. The capacitive element 28 makes it possible to reduce the size of the band 22. Still in a simplified manner, the position of the socket 24 with respect to the end of the band 22 conditions the reflection coefficient of the antenna 2. In practice, the designer of the antenna 2 performs numerous simulations to determine the respective positions and values of the connections 24 and 26 and of the element 28.

With the frequency bands used in mobile telephony, current antennas do not make it possible to obtain a sufficient passband width to cover both the low frequencies and the high frequencies of the mobile telecommunication standards.

Typically, to cover the frequency bands of the 4G standard, or even 5G standard, one needs to widen the band of operating frequencies of the antenna towards high frequencies (from 2.17 GHz for 3G to 2.7 GHz for 4G, and then to 3 GHz or more for 5G). This implies that the current architectures of PIFA antennas are no longer suitable for dropping low enough in frequency (for 4G, it is desired to have a passband dropping down to about 700 MHz and for 5G, to less than 500 MHz).

Moreover, it is henceforth desired that telephones be capable of picking up or covering several frequency bands simultaneously (carrier aggregation) so as to be able to increase the passband and the bitrates of data communication. This is in particular true for the 4G and 5G standards.

The embodiments described below propose new architectures of antennas aimed, inter alia, at improving the passband for a given size of conducting band 22, imposed by the constraints of the shell 4 of the telephone or, more generally, by the space available for the antenna 2.

Figure 3:
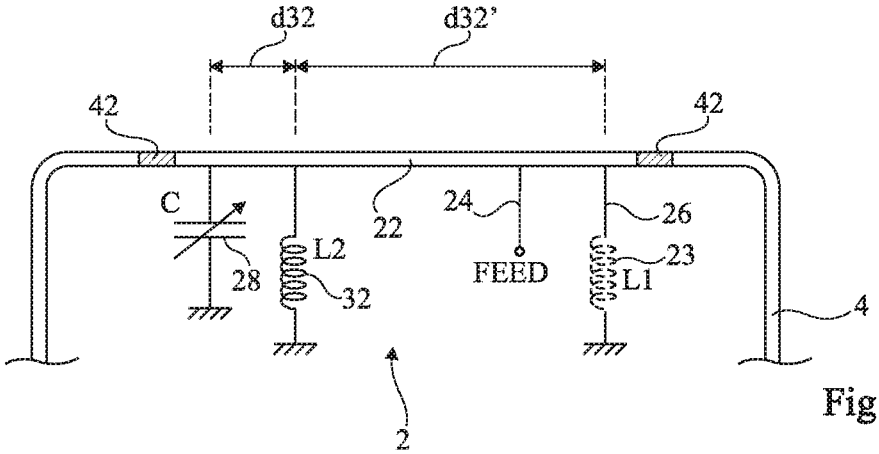
FIG. 3 is a schematic sectional view of an embodiment of a PIFA antenna.

FIG. 3 is a schematic sectional view of an embodiment of a PIFA antenna.

In FIG. 3, an antenna 2 produced with a band 22 of the type of that of FIG. 2B is taken as example. However, everything described below also applies to an antenna whose band 22 extends partially at the periphery of the longitudinal sides of the telephone (FIG. 2A).

Depicted therein are, in addition to the conducting band 22, the socket 24, the connection 26 to earth (direct or by way of an inductive component 23 illustrated dashed) and the capacitive element 28. According to this embodiment, an inductive element 32 links, in proximity to the capacitive element 28, the band 22 to earth. By proximity is meant that the distance d32 between the respective points of attachment of the element 32 and of the element 28 to the band 22 is less than the distance d32' between the point of attachment of the element 32 and the connection to earth 26.

The inductive element 32 may be on either side of the capacitive element 28.

Preferably, the elements 28 and 32 share one and the same point of attachment to the band 22, that is to say that the distance d32 is zero and the elements 28 and 32 are in parallel.

The inductive element 32 adds an inductance L2 in parallel with the capacitive element 28. This inductance L2 makes it possible to improve the range of variation of the adjustable capacitive element 28, and makes it possible to widen the passband towards the low frequencies, while facilitating the tuning and the choice of the low frequencies. For a given low-frequency limit, the smaller the distance d32, the smaller is the length of line afforded by the portion of band 22 between the points of attachment of the elements 28 and 32, and the higher may be the value of the inductance L2 and the better the efficiency.

The value of the inductance L2 is greater than the value of the inductance L1 afforded by the connection to earth. Preferably, the value of the inductance L2 is at least 5 times greater, preferably of the order of 10 times greater, than the value of the inductance L1.

For example, an antenna having a band of high frequencies (between about 1.7 and 2.7 GHz) and a band of low frequencies (between about 700 MHz and 1 GHz) is produced, this being particularly suitable for mobile telephony.

By way of particular exemplary embodiment, in applications to mobile telephony, with a conducting band 22 of a length of the order of 5 to 10 centimetres, the value of the inductance L2 is several tens of nanoHenry. The order of magnitude of the value of the capacitance C of the capacitive element 28 is a picoFarad. Such an antenna makes it possible to drop the low band to about 700 MHz, or even less.

Figure 4:
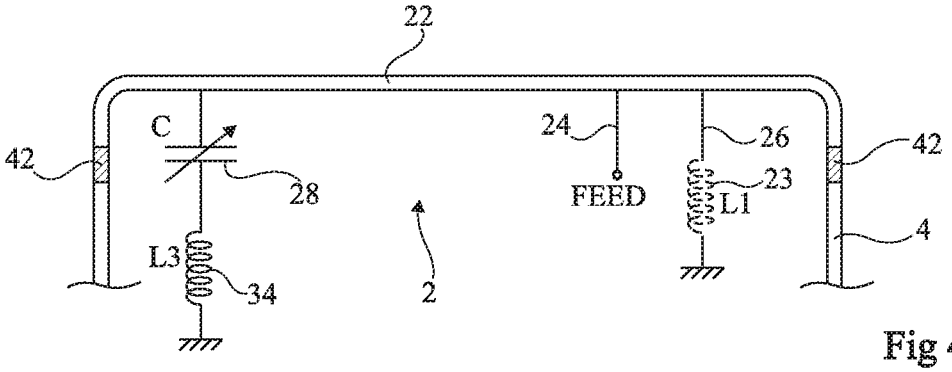
FIG. 4 is a schematic sectional view of another embodiment of a PIFA antenna.

FIG. 4 is a schematic sectional view of another embodiment of a PIFA antenna.

In FIG. 4, an antenna 2 produced with a band 22 of the type of that of FIG. 2A is taken as example. However, everything described hereinbelow also applies to an antenna whose band 22 does not extend beyond a side of the telephone (FIG. 2B).

Depicted therein are, in addition to the conducting band 22, the socket 24, the connection 26 to earth (direct or by way of an inductive component 23 illustrated dashed) and the capacitive element 28. According to this embodiment, an inductive element 34 is connected in series with the capacitive element 28. Thus, the band 22 is linked to earth by a series association of an adjustable capacitive element 28 of capacitance C and of an inductive element 34 of inductance L3.

Here, the inductive element 34 also makes it possible to improve the range of variation of the adjustable capacitive element 28, and makes it possible to widen the low passband towards the low frequencies.

The value of the inductance L3 is greater than the value of the inductance L1. Preferably, the value of the inductance L3 is at least 5 times greater, preferably of the order of 10 times greater, than the value of the inductance L1.

The embodiments of FIGS. 3 and 4 can be combined, that is to say that it is possible to produce an antenna 2 having an inductive element 32 in parallel with a series association of an adjustable capacitive element 28 and of an inductive element 34. In this case, the distance d32 (FIG. 3) between the respective points of attachment of the inductive element 32 and of the series association of the capacitive element 28 and of the inductive element 34, to the band 22, is less than the distance d32' between the point of attachment of the inductive element 32 and the connection to earth 26.

An advantage of such a combination is that the range of operating frequencies of the antenna is further improved. Typically, it is then possible to cover all the frequency bands and in particular also the frequencies of the 5G standard, that is to say in the range from 470 MHz to GHz. It is in particular possible to cover the three bands from about 470 MHz to about 960 MHz (about 490 MHz of passband), from about 1.350 GHz to about 1.535 GHz (about 175 MHz of passband) and from about 1.7 GHz to about 2.7 GHz, or even about 3 GHz.

Figure 5:
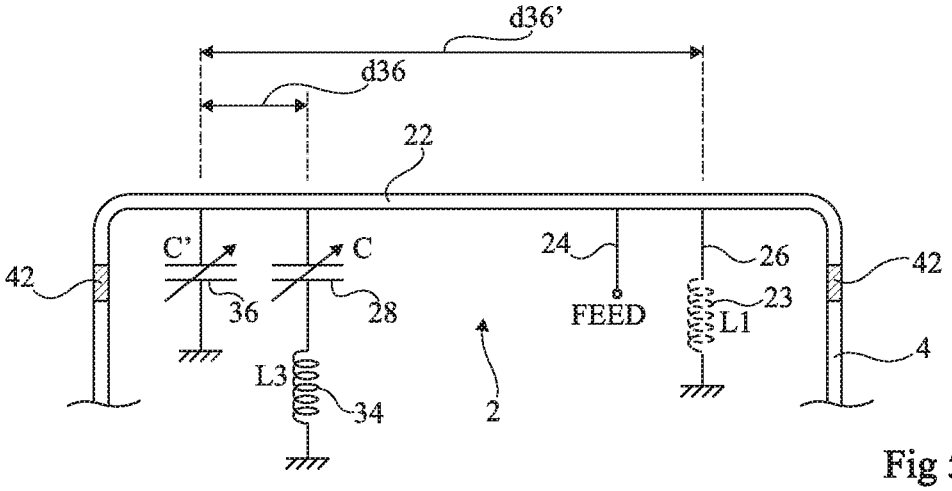
FIG. 5 represents a variant of the embodiment of FIG. 4.

FIG. 5 represents a variant embodiment of the embodiment of FIG. 4, according to which a second capacitive element 36, of adjustable capacitance C', is connected in proximity with the series association of the capacitive element 28 and of the inductive element 34. Just as for the embodiment of FIG. 3, by proximity is meant that the distance d36 between the respective points of attachment of the element 36 and of the series association of the elements 28 and 34 to the band 22 is less than the distance d36' between the point of attachment of the element 36 and the connection 26 to earth.

Just as for the inductive element 32 (FIG. 3), the capacitive element 36 may be on either side of the capacitive element 28.

Preferably, the point of attachment is common, that is to say that the distance d34 is zero and the element 36 is in parallel with the series association of the elements 28 and 34.

An advantage of the embodiment of FIG. 5 is that by keeping the other elements identical and, in particular without modifying the band 22, therefore the architecture of the shell 4 of the telephone, it is possible to displace the central frequency, thereby making it possible to displace the passband so as to improve frequency coverage.

An advantage of the embodiments which have been described is that they make it possible to improve the passband of a PIFA antenna, in applications using the standards and frequency bands of mobile telephony.

Another advantage is that the solutions described make it possible to produce antennas that are compatible with operation where all the frequency bands are covered simultaneously (carrier aggregation) with two antennas. Indeed, mobile telephones generally have two antennas.

Another advantage of the embodiments which have been described is that they are compatible with current telephone models. In particular, they do not require any modification of the electronic circuits, or of the conducting band 22 (therefore of the shell 4) but solely the addition of passive components (inductance(s) L2 and/or L3 and/or capacitance C').

Diverse embodiments and variants have been described. Certain embodiments and variants will be able to be combined and other variants and modifications will be apparent to the person skilled in the art. Moreover, the control of the adjustable capacitive elements has not been detailed. This control originates from the electronic circuits of the device using the frequency-tunable multiband antenna described, and is generated and is determined in the same manner as for the usual antennas. Finally, the practical implementation of the embodiments which have been described is within the scope of the person skilled in the art on the basis of the functional indications given hereinabove. In particular, the dimensioning of the inductive and capacitive components depends on the electronic device integrating the PIFA antenna and is within the scope of the person skilled in the art.

What is claimed is:

1. A device comprising:

shell comprising a first side, a second side, a third side, and a fourth side, the first side and the opposite second side being shorter than the third side and the opposite fourth side; and an inverted-f antenna disposed in the shell, the inverted-f antenna comprising a conducting band;

an antenna socket attached to the conducting band at a first position;

a first connection linking the conducting band to earth through only a first inductor attached at a second position, the first inductor having a first fixed inductance value;

a second connection linking the conducting band to earth through a first variable capacitor of adjustable capacitance, the second connection being attached at a third position, wherein the first position is between the second position and the third position; and a third connection linking the conducting band to earth through only a second inductor attached at fourth position, the second inductor having a second fixed inductance value, wherein the fourth position is disposed between the first position and the third position, wherein the conducting band is insulated from remaining portions of the shell by insulating portions, wherein the second fixed inductance value of the second inductor is at least five times greater than the first fixed inductance value of the first inductor, and wherein a passband of the inverted-f antenna is configured to be adjusted with only the variable capacitor during operation.

2. The device of claim 1, wherein a first distance between the first position and the fourth position is greater than a second distance between the fourth position and the third position.

3. The device of claim 1, wherein the conducting band overhangs the first side and extends partially over the lateral edges along the third and the fourth sides.

4. The device of claim 1, wherein the second connection further comprises a third inductor coupling the first variable capacitor to the earth.

5. The device of claim 1, wherein the antenna comprises a short-circuited quarter-wave antenna.

6. The device of claim 1, wherein the antenna comprises passbands in the range lying between about 700 MHz and 2.7 GHz.

7. The device of claim 1, wherein the antenna comprises passbands in the range lying between about 470 MHz and 3 GHz.

8. The device of claim 1, further comprising:

a switch coupled to an electronic circuit configured to generate and receive signals;

a filter coupled to the switch; and an antenna switch coupled to the filter, wherein the antenna is coupled to the antenna switch.

9. The device of claim 8, further comprising a frequency adjustment circuit coupled between the antenna and the antenna switch.

10. A device comprising:

a shell comprising a first side, a second side, a third side, and a fourth side, the first side and the opposite second side being shorter than the third side and the opposite fourth side; and an antenna disposed in the shell, the antenna comprising a conducting band;

an antenna socket attached to the conducting band at a first position;

a first connection linking the conducting band to earth through only a first inductor attached at a second position, the first inductor having a first fixed inductance value;

a second connection linking the conducting band to earth through a first variable capacitor of adjustable capacitance and a second inductor, the second inductor having a second fixed inductance value, the second connection being attached at a third position, wherein the first position is between the second position and the third position, wherein a first distance between the first position and the second position is less than a second distance between the first position and the third position, wherein the conducting band is insulated from remaining portions of the shell by insulating portions; and a third connection linking the conducting band to earth through only a third inductor attached at fourth position, the third inductor having a third fixed inductance value, wherein the fourth position is disposed between the first position and the third position, wherein the third fixed inductance value of the third inductor is greater than the first fixed inductance value of the first inductor, and wherein a passband of the antenna is configured to be adjusted with only the variable capacitor during operation.

11. The device of claim 10, wherein the inductance value of the second inductor is at least five times greater than the inductance value of the first inductor.

12. The device of claim 10, wherein the conducting band overhangs the first side and extends partially over the lateral edges along the third and the fourth sides.

13. The device of claim 10, wherein a first distance between the first position and the fourth position is greater than a second distance between the fourth position and the third position.

14. The device of claim 10, wherein the antenna comprises a short-circuited quarter-wave antenna.

15. The device of claim 10, wherein the antenna comprises passbands in the range lying between about 700 MHz and 2.7 GHz.

16. The device of claim 10, wherein the antenna comprises passbands in the range lying between about 470 MHz and 3 GHz.

17. The device of claim 10, further comprising:

a switch coupled to an electronic circuit configured to generate and receive signals;

a filter coupled to the switch; and an antenna switch coupled to the filter, wherein the antenna is coupled to the antenna switch.

18. The device of claim 17, further comprising a frequency adjustment circuit coupled between the antenna and the antenna switch.

19. A antenna comprising:

a conducting band;

an antenna socket attached to the conducting band at a first position;

a first connection linking the conducting band to earth through a first inductor attached at a second position, the first inductor having a first fixed inductance value;

a second connection linking the conducting band to earth through a first variable capacitor of adjustable capacitance, the second connection being attached at a third position, wherein the first position is between the second position and the third position; and a third connection linking the conducting band to earth through a second inductor attached at fourth position, the second inductor having a second fixed inductance value, wherein the fourth position is disposed between the first position and the third position, wherein the second fixed inductance value of the second inductor is at least five times greater than the first fixed inductance value of the first inductor, wherein the antenna is a planar inverted-f antenna, and wherein a passband of the antenna is configured to be adjusted with only the variable capacitor during operation.

20. The antenna of claim 19, wherein the antenna comprises a short-circuited quarter-wave antenna having passbands in the range lying between about 700 MHz and 2.7 GHz.

* * * * *